US006241640B1

(12) United States Patent
Chu

(10) Patent No.: US 6,241,640 B1
(45) **Date of Patent: *Jun. 5, 2001**

(54) BOXING EXERCISE APPARATUS

(76) Inventor: Yong S. Chu, 1225 Raymond Ave., Glendale, CA (US) 91201

( * ) Notice: Subject to any disclaimer, the term of this patent is extended or adjusted under 35 U.S.C. 154(b) by 0 days.

This patent is subject to a terminal disclaimer.

(21) Appl. No.: 09/038,886

(22) Filed: Mar. 11, 1998

(51) Int. Cl.[7] ..... A63B 69/00
(52) U.S. Cl. ..... 482/83; 482/86; 482/87
(58) Field of Search ..... 482/83, 87, 90, 482/137; 473/441–445

(56) References Cited

U.S. PATENT DOCUMENTS

| | | | |
|---|---|---|---|
| 885,927 | 4/1908 | Hulsmann . | |
| 3,281,148 | 10/1966 | Cummins . | |
| 3,427,021 | 2/1969 | Donato . | |
| 3,927,879 | 12/1975 | Long et al. . | |
| 4,093,212 | 6/1978 | Jacques . | |
| 4,491,316 | 1/1985 | Prince . | |
| 4,749,184 | 6/1988 | Tobin . | |
| 4,836,533 | 6/1989 | Dong . | |
| 5,342,267 | 8/1994 | Adams et al. | 482/83 |
| 5,464,377 | 11/1995 | Beeman | 482/83 |
| 5,984,842 | * 11/1999 | Chu . | |

FOREIGN PATENT DOCUMENTS

| | | | |
|---|---|---|---|
| 286512A | 1/1991 | (DE) | A63B/69/34 |
| 1507410 | 9/1989 | (SU) | A63B/69/34 |
| 1713606-A1 | 9/1989 | (SU) | A63B/69/34 |

* cited by examiner

*Primary Examiner*—Jerome Donnelly
(74) *Attorney, Agent, or Firm*—Gene Scott-Patent Law & Venture Group

(57) ABSTRACT

A boxing exercise apparatus is mounted onto a stand. A pivoted support arm provides a strike absorbing means. In a first embodiment, the support arm is connected to the stand with a spring joined to a rigid rod. The rigid rod is preferably positioned in a neutral position with an integral positioning means. Displacement of the support arm away from the neutral position toward at a rocked-back position is counteracted by the spring. In a second embodiment, the apparatus further includes a second spring joining the stand and the rigid rod; and a second positioning means for contacting the rigid rod. When the support arm is deflected, alternately the first spring and then the second spring retards the motion of the support arm. In a third embodiment, a pair of strike absorbing means are mounted in such a manner that they move away from a blow and recover a neutral position as described, and also move laterally, and again recover a neutral position.

9 Claims, 5 Drawing Sheets

BOXING EXERCISE APPARATUS

BACKGROUND OF THE INVENTION

1. Field of the Invention

The invention relates generally to athletic training equipment, and more particularly to a boxing exercise apparatus useful for striking and punching exercises.

2. Description of Related Art

The following art defines the present state of this field:

Adams et al., U.S. Pat. No. 5,342,267 describes an improved striking device is provided as including a main post having two main longitudinal slots. An insert post having an outside diameter that is less than the inside diameter of the main post is provided. A striking surface is provided that is attached to an arm which in turn is attached to an arm housing. The arm housing has a first housing end and a second housing end. The arm housing is placed around the main post and the second housing end rests upon a support axle passing through the insert post. The first housing end includes a cam surface having two peaks located on opposite sides thereof and two valleys located on opposite sides thereof with each of the two valleys disposed between each of the two peaks. A cam follower is included which is retained in contact against the cam surface by a pair of springs. During rotation of the arm housing the cam follower cooperates with the cam surface of the arm housing to provide a first striking position and a second striking position that are each located on hundred and eighty degrees of rotation apart with respect to each other. As the arm housing rotates the cam surface extends the cam follower which in turn extends the pair of springs in proportion to the contour of the cam surface. If sufficient force is imparted to the striking surface, the arm housing is urged away from the first striking position, and indexes into the second striking position.

Beeman, U.S. Pat. No. 5,464,377 describes a striking target for use in the practice of martial arts including a semi-cylindrical base frame secured to a foundation with the base frame having an upper rim forming a track extending in a substantially horizontal plane. An elbow shaped pivot arm is pivotally mounted radially inward of the track and has a horizontal extension extending over the track and adapted to engage and traverse the track. At least one cam surface is integral the track to form a raise or protuberance and inhibit the movement of the pivot arm across the track. A resilient member is attached to the pivot arm to oppose the force applied to the target member by striking it.

Dong, U.S. Pat. No. 4,836,533 describes a variable tension loaded striking apparatus comprising a base having a pair of spaced upstanding ears between which are disposed a holder portion, the holder portion also being secured at one end of an adjustable air or hydraulic compression device, which at its opposite end is connected to the base of the apparatus. Removably disposed within the holster portion is a striking board which is a plank or similar material adapted to serve as a blow receiving surface.

Tobin, U.S. Pat. No. 4,749,184 describes a kicking practice apparatus including a freestanding support frame having spaced-apart upstanding members mounted at their lower ends to a floor-supported primary base and rigidly connected at their upper ends by a reinforcing structure. The upstanding members are disposed in a generally triangular arrangement. An impact-receiving member has a pivot sleeve mounting the member to a front one of the support frame members such that the impact-receiving member extends in cantilever fashion generally outwardly from the front member and away from a rear pair of the support frame members. The impact-receiving member is pivotable relative to the front member in transverse relation thereto and in either clockwise or counterclockwise directions thereabout. Sets of resiliently yieldable springs and elastic cords extend in opposing relation to one another past and in contact with the pivot sleeve and interconnect the impact-receiving member with the rear pair of members. The springs and cords impose a restoring force on the impact-receiving member and a dampening force on the pivot sleeve for maintaining the impact-receiving member at an initial rest position and returning the impact-receiving member to the rest position with occurrence of only negligible oscillation after pivoting of the impact-receiving member in either direction in response to an impact being applied to the member. Also, the support frame can include a secondary base and bracing members interconnecting the primary base and reinforcing structure with the secondary base to support the upstanding members in including positions.

Prince, U.S. Pat. No. 4,491,316 describes an apparatus for practicing the defense arts such as karate including a frame having a vertical mast member on which a universal support bracket is mounted for supporting articles to be struck by the artisan. The support bracket provides a substantially clear span between portions of the article that are supported to minimize the risk of injury. Detachable target members are adapted for mounting on the universal support bracket and are provided with visual and/or audible indicators for measuring the accuracy and intensity of blows delivered to the target members.

Jacques, U.S. Pat. No. 4,093,212 describes a punching bag useful in training fighters in developing an effective uppercut includes a vertical member for attachment to the wall having disposed rotatably thereon a horizontal bar containing on its end a padded arm terminating in a rounded portion which simulates the chin of a fighter. The horizontal arm is limited in its downward travel by a hard rubber stop and is biased to the horizontal position by a heavy tension spring but is free to rotate upward against the tension of the spring allowing the training fighter to practice uppercuts on the end thereof and develop the necessary muscles required for such a punch.

Long et al., U.S. Pat. No. 3,927,879 describes a punching bag simulator has a base for mounting on a stationary surface and a spring biased arm pivotally connected to the base and constrained to move only in a single plane with one end of the arm biased by the spring against a resilient bumper. On the other end of the arm a deformable pad is presented for striking by the fists and each time the pad is struck, the arm moves along a lineal path against the spring bias and snaps back to its original position for repeated striking. A pair of resilient bumper elements are placed between the pivoted arm and base in spaced relation to each other. One resilient element serves to absorb kinetic energy of the pivot arm when the pivot arm is moved towards the base against the spring bias and the other resilient element serves to absorb the kinetic energy of a pivot arm when the pivot arm is moved away from the base as a result of the spring bias.

Cummins, U.S. Pat. No. 3,281,148 relates to football practice and conditioning equipment and more particularly to a suspension apparatus for suspending a tackling dummy. The object of this invention is to provide suspension apparatus for suspending a tackling dummy in such manner that the dummy will react to a charging football player in substantially the same way as a live opponent. A more specific object of the invention is to provide such suspension apparatus having means transferring to a suspended dummy a resistance to free swinging motion similar to the resistance afforded by an opposing player. Another more specific object of the invention is to provide a suspension apparatus having the above characteristics wherein means are provided for effecting an initial resistance which is effective at the moment of contact with a suspended dummy and for providing a lesser, follow-through resistance as the dummy swings away from a charging player.

J. A. Donato, U.S. Pat. No. 3,427,021 describes a striking device having telescopic tubes, one carrying a striking pad at its free end and the other being mounted on a base attachable to a supporting surface, spaced ball bearing assemblies between the tubes at axially spaced locations to provide bearing support and guidance of one tube by the other, a spring disposed within the telescoped tubes to resiliently urge the striking pad away from the base, and cables interconnecting the striking pad and base to limit movement of the striking pad away from the base, the cables having a spring-connected anchor with the base to absorb shock upon rebound of the striking pad away from the base. The telescoping tubes are attached to the base by an angularly adjustable connector. The connector comprises two plates, one attached to the base and having a plurality of holes therein. Attached to the tubes is the second plate which is also pivotally attached to the first plate and has at least one hole therein. A removable pin extends through one of the holes in the first plate and the hole in the second plate to prevent relative angular movement therebetween.

F. Hulsmann, U.S. Pat. No. 885,927 provides this invention relates to punching-bag apparatus of the type wherein the bas is suspended by an arm or rod having a universal mounting in the overhead support and having also a buffer such as a rubber boss, which strikes against a plate of relatively small area, whereby a rebound is secured without causing the bag itself to strike against a ring or platform. Punching-bag apparatus of this character is, as regards the mode of rebound, much less noisy than the rebounding bag style, is less damaging to the bag and its suspending member, and occupies less room but hitherto has been defective in essential particulars which have hindered it practical adoption. This invention aims to overcome. This invention aims to overcome prior defects. Which reside principally in the mode of mounting the suspending rod to give it universal swinging movement; in the absence of adequate means for effecting a quick return of the bag toward its vertical position particularly when struck with only partial force which fails to carry the buffer against the striking plate; and in the absence of proper connections between the bag and its suspending-rod which will allow the bag to be readily inflated and yet afford a durable connection capable of surviving the rough usage administered.

Hoff, DD 285-512-A describes the movable boxing trainer has its own working platform with two rollers. The punch dummy is height-adjustable via a tubular section which is connected to a spring joint. The angle of this is adjusted via a threaded spindle.

Odpo, SU 1507-410-A provides the device comprises a model of a boxer. Its body is covered in soft upholstery. There is a bearing on the body, with concentric rings. The rings are connected to each other by a bolt. Arms are pivoted to the outer ring. Their turning axes are vertical. The arms are spring to the outer ring. Ann movement limiters are fitted on the outer ring. The distance L between the boxing gloves can be varied. When one of the gloves is hit, the other glove hits the boxer if his reaction is slow.

Uype, SU 1713606-A1 provides training device comprises handle, which may be cone-shaped, attached to weight through elastic element. The vertical axis of handle is set at a distance L from the center of mass of weight. An elastic element is suspended on a hinge from a horizontal rod, which is connected to a handle through a threaded bush. The end of the rod has a limiting stop at the end. The sportsman holds the handle with his hand and raises the device. The intensification of training can be increased by oscillating the weight. The device helps simulate the reaction of the opponent's arm to various movements.

The prior art teaches devices which are useful for assisting boxers and martial artists in practicing their striking techniques. However, the prior art inventions are generally heavy and cumbersome devices which are not efficient in dampening the force of a strike. The prior art does not teach a simple and light apparatus capable of a wide range of dynamic response characteristics. The prior art also does not teach a strike absorbing apparatus capable of very fast recovery after absorbing a strike. The prior art does not teach such an apparatus enabled for moving laterally after a strike and recovering therefrom. The present invention fulfills these needs and provides further related advantages as described in the following summary.

SUMMARY OF THE INVENTION

The present invention teaches certain benefits in construction and use which give rise to the objectives described below.

The present invention provides embodiments of a boxing exercise apparatus which absorbs the impact of a strike from the hands, arms, legs, feet or head upon the apparatus by the user. The apparatus has a stand providing a base for resting or attaching the apparatus to a floor, wall or ceiling. The stand is hingably connected to a support arm having a strike absorbing means. In a first embodiment, the apparatus moves back and forth while recovering from a strike and the recovery is accelerated by a spring and a rigid rod arrangement. The rigid rod is preferably positioned for contacting and for moving along a sliding surface when the strike absorbing means is deflected toward a rocked-back position thereby causing the spring to retard the motion of the support arm, and whereby the rigid rod is lifted away from the sliding surface when the strike absorbing measn is deflected toward a rocked-forward position, again causing the spring to retard the motion. One of the benefits of this embodiment is that only one spring is required.

In a second embodiment, the apparatus further includes a second spring. The second spring. In this embodiment, when the support arm is deflected toward the rocked-back position the rigid rod is prevented from moving by a positioning means. Thus, when the support arm is deflected toward the rocked-back position the first spring retards the motion of the support arm. When the support arm is deflected toward the rocked-forward position, the second spring retards the motion of the support arm.

In a third embodiment, the apparatus is constructed to deflect laterally as well as forward and rearward after receiving a strike.

A primary objective of the present invention is to provide a boxing exercise apparatus having advantages not taught by the prior art.

Another objective is to provide an apparatus that is smaller and lighter than the prior art.

Another objective is to provide a punching bag means with a greater range of motion then is found in the prior art.

Another objective is to provide an apparatus that can be adjusted to provide a desired deflection characteristic.

A further objective is to provide an apparatus which is critically damped so as to recover its neutral position in as short a time as possible following each strike.

A still further objective is to provide such an apparatus that includes a pair of spaced apart strike absorbing means which move forward and backward after receiving a strike, and also move laterally.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
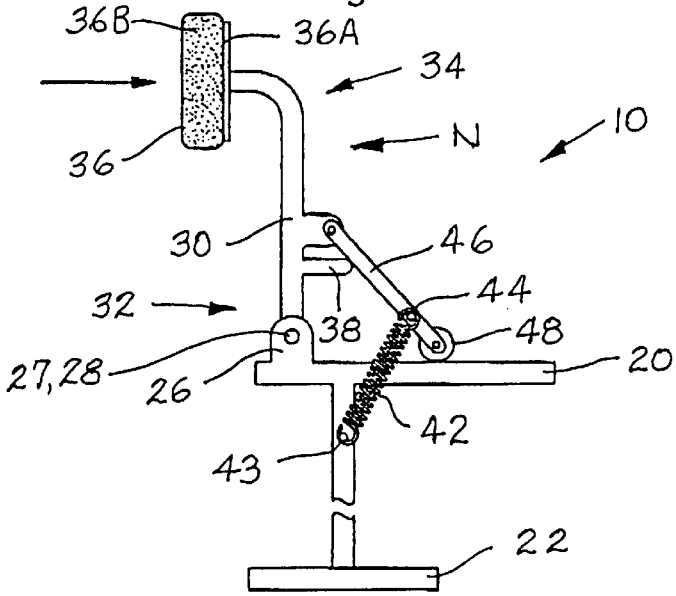
FIG. 1 is a side elevational view of a first embodiment of the present invention, showing a support arm in a neutral position.
Figure 2:
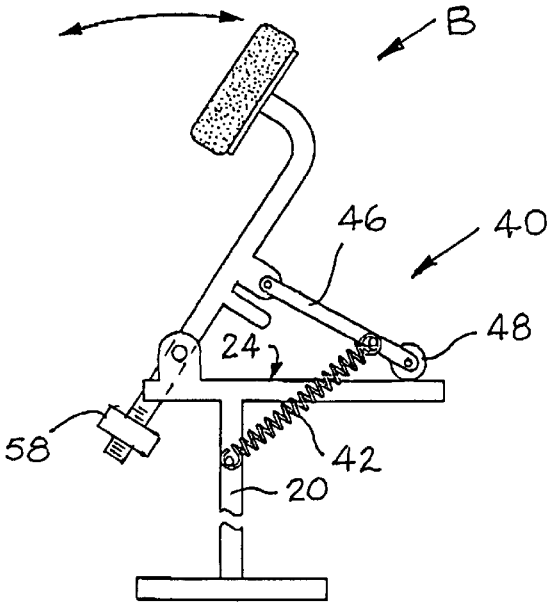
FIG. 2 is a side elevational view thereof, showing the support arm in a rocked-back position.
Figure 3:
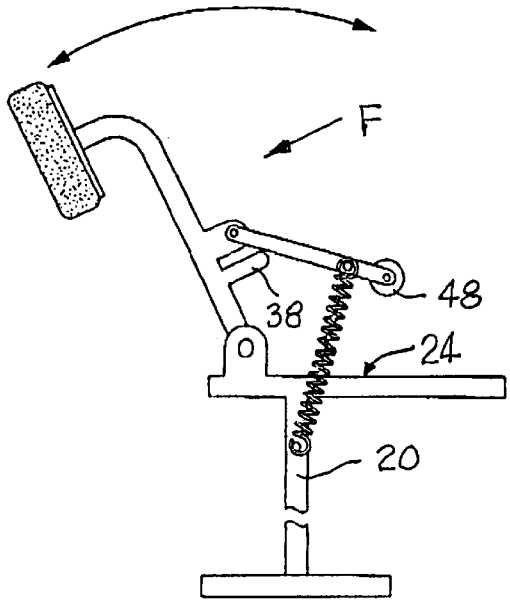
FIG. 3 is a side elevational view thereof, showing the support arm in a rocked-forward position, the movement of the support arm being exaggerated for purposes of illustration.

The above described drawing figures illustrate the invention, a boxing exercise apparatus 10. The apparatus 10 has a stand 20 providing a base 22 for resting or attaching the apparatus 10 to a floor, wall or ceiling. Both the stand 20 and the base 22 are preferably made of a structural material such as steel, providing the apparatus 10 with strength, durability, and stability. In a first embodiment, as shown in FIGS. 1–3, the base 22 is placed on or bolted to a supporting surface. The moderately heavy steel of the base 22 provides the apparatus 10 with added stability; however, the base 22 does not need to be as heavy as similar prior art devices because, as described below, the present invention absorbs much of the energy of the strikes without transmitting the energy to the base 22. In a second embodiment, as shown in FIGS. 4–6, the base 22 is, again, attached to a ceiling, floor or wall, preferably with screws, bolts or similar attachment means.

The apparatus 10 includes a support arm means 30 having a distal end 32 and a proximal end 34. The distal end 32 is hingably engaged with the stand 20 enabling the support arm means 30 to swing from a rocked-back position B, to a rocked-forward position F, a neutral position N defines a rest position of the invention. The support arm means 30 preferably has a pivoting axle 28 integrated at its distal end 32. The stand 20 preferably has a bracket 26 having an axle receiving hole 27. The axle 28 rotatably engages the axle receiving hole 27, achieving a hingable connection between the stand 20 and the support arm means 30. The bracket 26 is preferably a pair of flanges receiving the support arm means 30 between them, and may include a means for tightening-down on the axle 28 so as to frictionally adjust the freedom of movement of the arm means 30. In this case, the axle receiving hole 27 passes through the pair of flanges 26, allowing the axle 28 to rotatably engage the support arm means 30. The neutral position N preferably places the support arm means 30 in a position which is approximately perpendicular to the support surface. A strike absorbing means 36 is attached at the proximal end 34 of the support arm means 30 and is movable therewith. The strike absorbing means 36 preferably has a padded striking surface, although some martial artists may prefer an unpadded surface. In the first embodiment, as shown in FIGS. 1–3, the strike absorbing means 36 comprises a rigid backing 36A and a pad 36B made of cloth, rubber or plastic sheet material filled with foam rubber or other appropriate material as is well known. In the second embodiment, as shown in FIGS. 4–6, the strike absorbing means 36 has a rectangular cover 36C which fits over the proximal end 34 of the support arm means 30, thereby allowing the user to strike the strike absorbing means 36 from either side of the support arm means 30. In further possible alternative embodiments, the strike absorbing means 36 may be adapted to meet the individual needs of the user. In such embodiments, various materials might be removably engagable with the support arm means 30 to provide strike absorbing means 36 with an appropriate resilience and texture for boxing or martial arts training. Some of the possible attachments are discussed in Adams, et al., U.S. Pat. No. 5,342,267, which is herein incorporated in full by reference. A primary biasing means 40 comprises a pair of elements which cooperate with each other; a primary energy storing means 42 joined with a rigid rod means 46. The primary energy storing means 42, preferably a coil spring, is preferably adjustable to provide a selectable level of stiffness (to provide a desired bouncing characteristic) to the movement of the support arm means 30. In its preferred embodiment, the energy storing means 42 can be interchanged with either stronger or weaker springs to accommodate the user's individual requirements. The rigid rod means 46 is preferably a rigid structural rod, preferably having a roller means 48 such as a wheel at the end opposite the support arm means 30. The primary biasing means 40 engages at one end 43 thereof with the stand 20 and at the other end 44 thereof with the support arm means 30 so as to urge the support arm means 30 toward the neutral position N. As shown in FIGS. 1–3, the rigid rod means 46 is pivotally connected to the support arm means 30 and the primary energy storing means 42 is removably attached to both the rigid rod means 46 and the stand 20. The support arm means 30 provides an integral first elongate positioning means 38 extending outwardly from the support arm means 30 for contacting the rigid rod means 46 so as to position the support arm means 30 with respect to the stand 20. In this configuration, displacement of the support arm means 30, i.e., being rocked forward or backward, is counteracted by the primary biasing means 40. The rigid rod means 46 is preferably positioned for contacting and for moving along a sliding surface 24 of the stand 20, preferably on the roller means 48. As shown in FIG. 2, when the support arm means 30 is rocked back, the energy storing means 42 retards the motion of the support arm means 30. As shown in FIG. 3, when the support arm means 30 is rocked forward during recovery from a strike, the rigid rod 46 is lifted away from the sliding surface 24 thereby causing the energy storing means 42 to retard the motion of the support arm means 30. Therefore, the strike absorbing means is able to move to the neutral position N very quickly so that another strike may be made with a minimum of waiting. It should be realized that this configuration can be reversed, such that the rigid rod 46 and the first elongate positioning means 38 are connected to the stand 20 and the energy storing means 42 is attached to the support arm means 30, without altering the operation of the invention. Furthermore, instead of using a first elongate positioning means 38, the rigid rod 46 can either be bent or have a finger protruding from it in order to achieve the same result as that shown in the present drawing figures. These many combinations of elements or their equivalents are considered to be within the scope of this invention.

Figure 4:
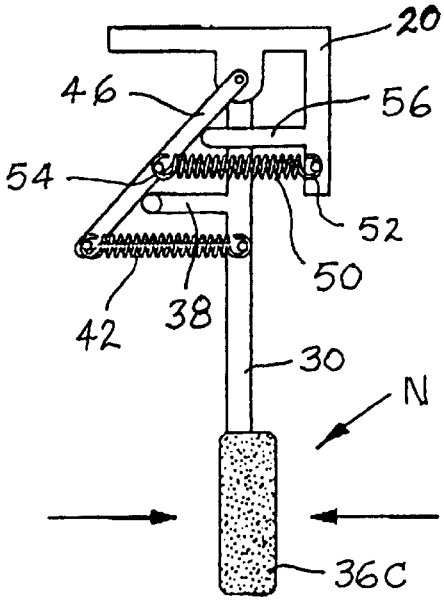
FIG. 4 is a side elevational view of a second embodiment of the present invention, showing the support arm in a neutral position.
Figure 5:
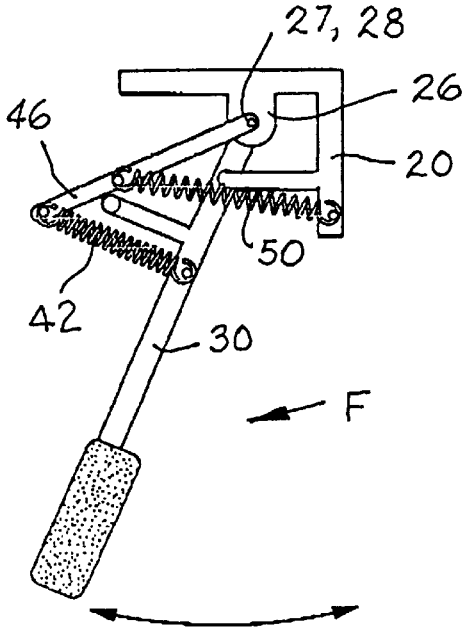
FIG. 5 is a side elevational view thereof, showing the support arm in a rocked-forward position.
Figure 6:
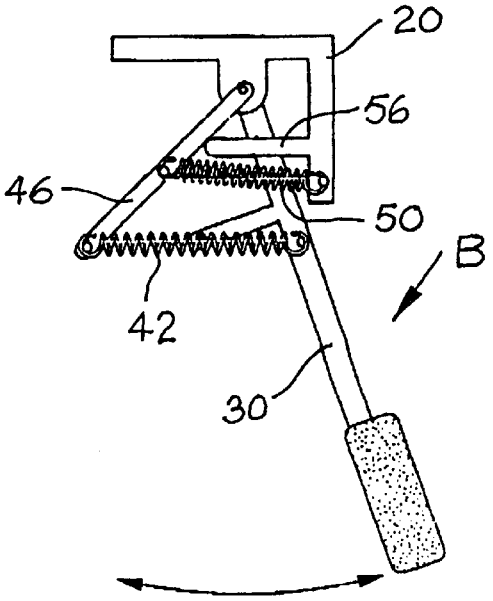
FIG. 6 is a side elevational view thereof, showing the support arm in a rocked back position.

In the second embodiment, as shown in FIGS. 4–6, the apparatus 10 further includes a secondary energy storing means 50, again, preferably a coil spring. The secondary energy storing means 50 is joined at a first end 52 thereof with the stand 20 and at a second end 54 thereof with the rigid rod means 46. As shown in FIG. 5, when the support arm means 30 is rocked forward, the secondary energy storing means 50 retards the motion of the support arm means 30. When the support arm means 30 is rocked back, as shown in FIG. 6, the primary energy storing means 42 retards the motion of the support arm means 30. In this embodiment, the apparatus 10 preferably further includes a second elongate positioning means 56 joined integrally with and extending outwardly from the stand 20 for contacting the rigid rod means 46 so as to advantageously position the primary energy storing means 42 with respect to the stand 20 whereby when the support arm means 30 is rocked back, the rigid rod means 46 is prevented from moving therewith. As stated above, many of these elements can be inverted or replaced with an equivalent mechanism without changing the essence of the invention.

As shown in FIG. 2, a weight means 58 may be threadably, or otherwise engaged with the support arm means 30 to counterbalance the arm means 30. Selection of the mass of the weight means 58 and its position relative to pivoting axle 28 as well as the spring constants of the energy storing means 42 and 50 enables the apparatus 10 to be easily modified to provide a wide range of dynamic characteristics and to extend its use to a wide range of user needs.

Figure 7:
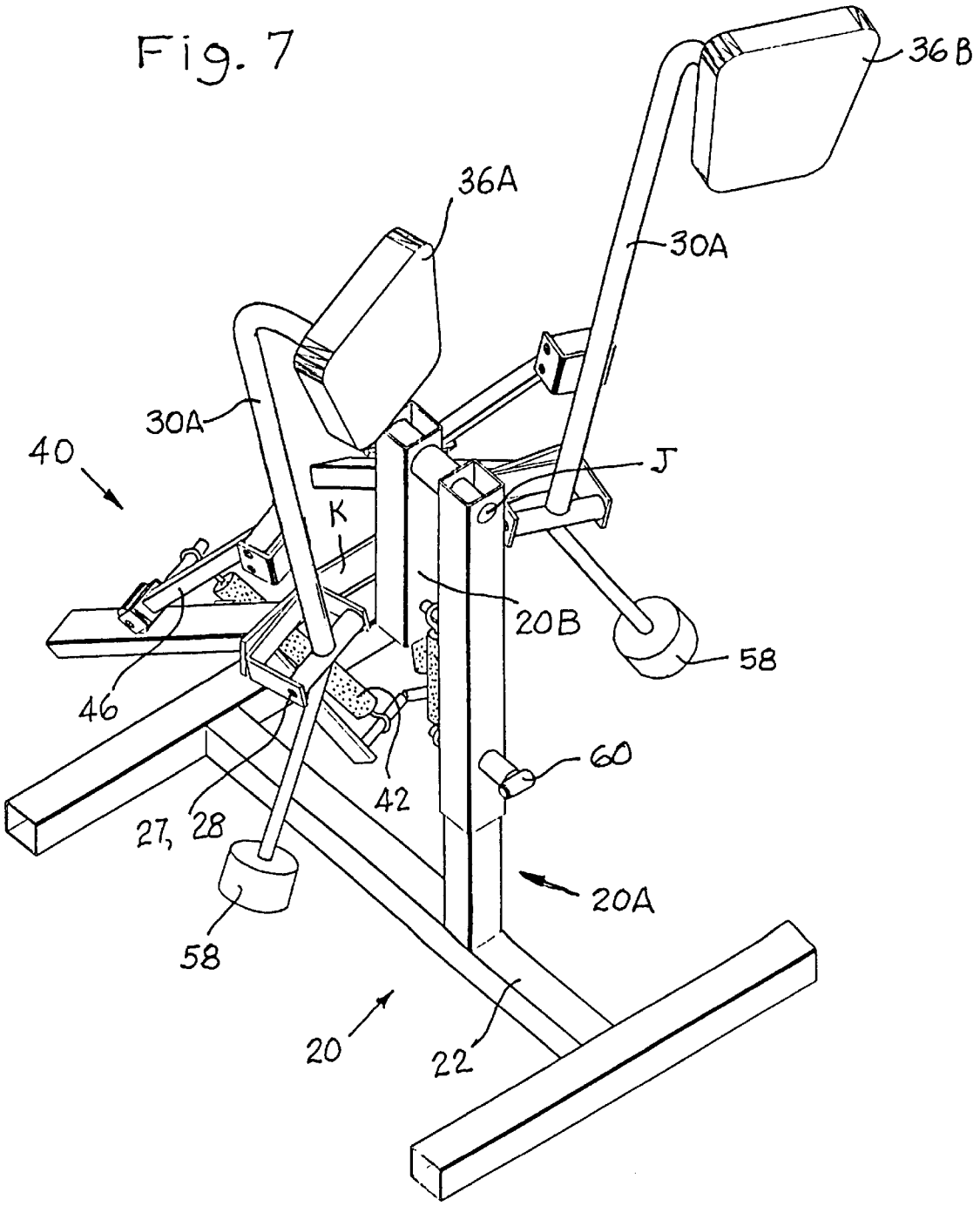
FIG. 7 is a perspective view of a third embodiment of the present invention, showing the support arm in a neutral position.
Figure 8:
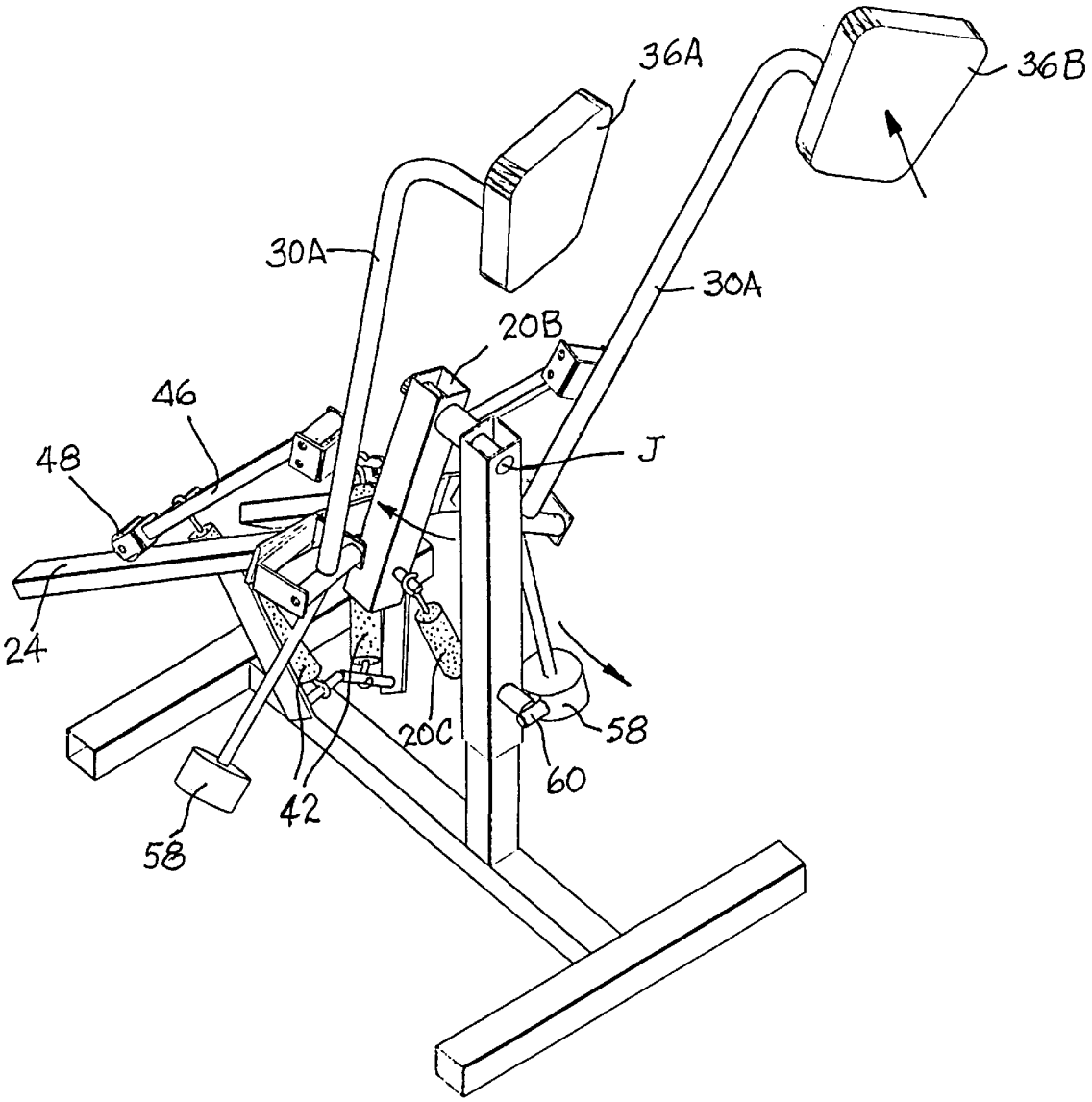
FIG. 8 is a perspective view thereof, showing the support arm tilted to the left side of the apparatus after receiving a blow to the right side.
Figure 9:
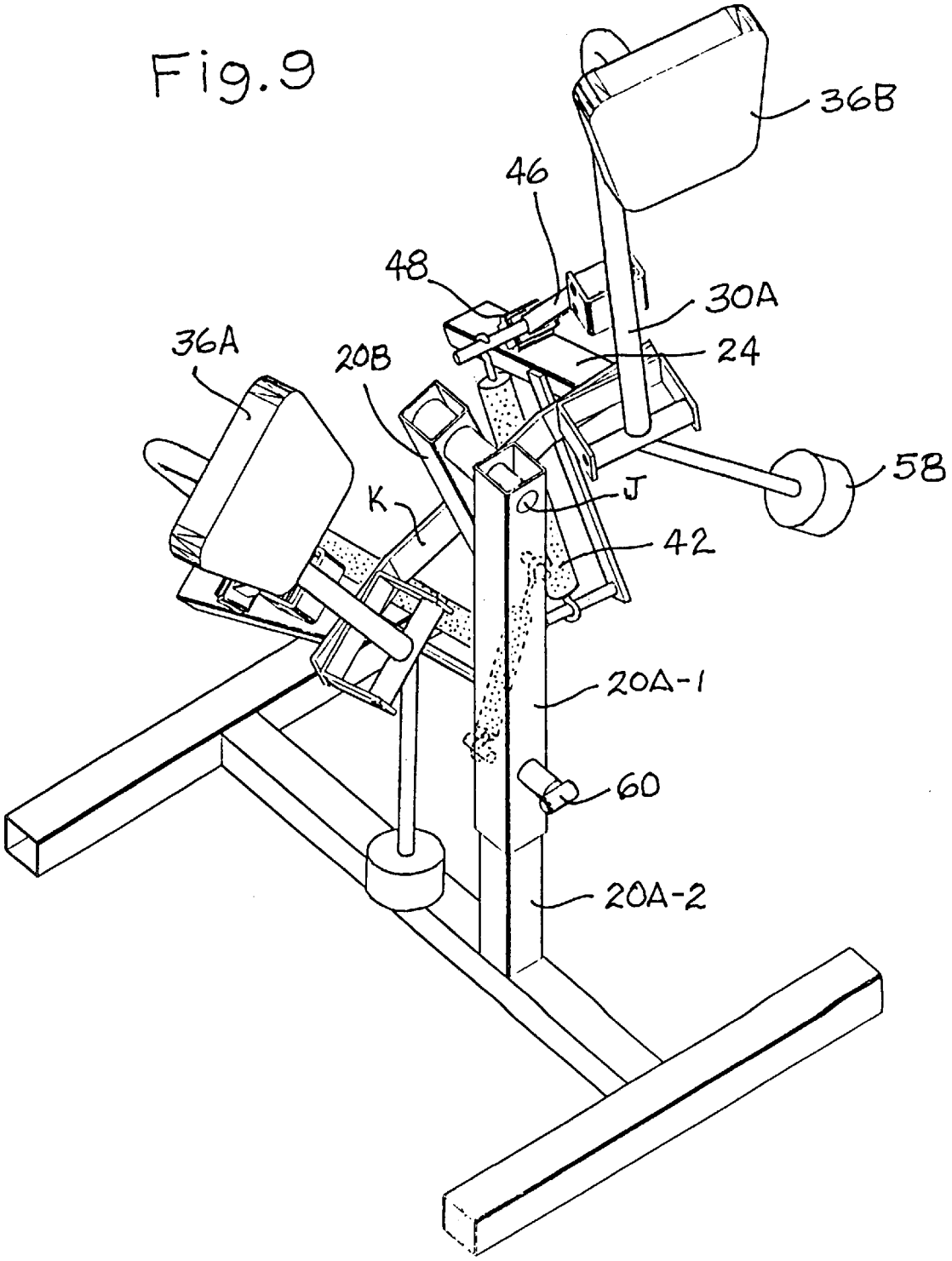
FIG. 9 is a perspective view thereof, showing the support arm tilted to the right side of the apparatus after receiving a blow on the left side.

FIGS. 7–9 illustrate a further embodiment of the invention wherein the support arm means 30 comprises a pair of spaced apart struts 30A each having a distal end and a proximal end. The distal ends are each hingably engaged with the stand 20 enabling each of the struts 30A to move independently between the rocked-back position B and the rocked forward position F. The strike absorbing means 36 comprises strike absorbing means 36A and 36B respectively, and these are attached at the proximal end of each of the struts 30A and are fully movable therewith. The primary biasing means 40 comprises a pair of the primary energy storing means 42 and a pair of the rigid rod means 46, one of the primary biasing means 40 being engaged at one end thereof with the stand 20 and at the other end thereof with one of the struts 30A so as to urge each of the struts 30A toward the neutral position N. Displacement of either of the struts 30A away from the neutral position is counteracted by the primary biasing means 42. Please note that in FIGS. 7–9 the biasing means are shown as rod shaped elements which may be air cylinders, elastic rods, coil springs, or other biasing or energy absorbing means as is known in the art. The weight means 58 may be removably engagable with the struts 30A and is positioned for counteracting, by acting as a counterbalance, the motion of the struts 30A as shown.

The embodiment shown in FIGS. 7–9 provides a further degree of motion as compared to the previously described embodiments. Notice that the stand 20 includes a primary stand arm 20A, upwardly extending from the base 22, and a secondary stand arm 20B pivotally joined at J to the primary stand arm 20A so as to laterally move with respect thereto. The struts 30A are pivotally joined to the secondary stand arm 20B by rigid arm K and are therefore laterally movable therewith. A secondary stand arm bias means 20C is best seen in FIG. 8, and is positioned and engaged for urging the secondary stand arm 20B so as to preferably position the strike absorbing means 36A and 36B in a common horizontal position. In FIGS. 8 and 9 the secondary stand arm 20B is shown pivoted to the right and to the left respectively and in each case it is brought back to the position shown in FIG. 7 by stand arm bias means 20C. The primary stand arm 20A may be segmented and adapted as shown so as to adjust the height of the apparatus for a particular individual or purpose, as for receiving hand blows or foot blows. The spring loaded pin 60 is a well known enablement for locking an upper segment 20A-1 of the primary stand arm 20A to wer segment 20A-2 after telescopic adjustment is made.

In the embodiment of FIGS. 7–9 when one of the strike absorbing means 36A or 36B is struck, it moves toward the rocked-back position B as shown in FIG. 2, and also, due to the off-center impact location, angle of the striking means and location of its pivot, the secondary stand arm 20B is forced to swing to the opposite side of the apparatus as shown in FIG. 8 when a blow is received by strike absorbing means 36B. In this case, the secondary stand arm 20B pivots laterally to the left. FIG. 9 shows the opposite action. The double action of moving both away from the blow and to one side is considered novel and highly desirable as it enables a more realistic fighting practice relationship between the fighter and the machine. The weight means 58 tends to force the strike absorbing means 36 toward the neutral position N. The stand arm biasing means 20C tend to being the strike absorbing means back to a common level position after each blow. The primary energy storage means 42 tends to move the strike absorbing means 36 toward the neutral position.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A boxing exercise apparatus comprising:

a stand providing a base for supporting the apparatus;

a support arm means having a distal end and a proximal end, the distal end being hingably engaged with the stand enabling the support arm means to move between a rocked-back position and a rocked forward position, a neutral position thereof dividing the rocked-back and the rocked-forward positions;

a strike absorbing means attached at the proximal end of the support arm means and movable therewith;

a primary biasing means comprising a primary energy storing means joined with a rigid rod means, the primary biasing means being engaged at one end thereof with the stand and at the other end thereof with the support arm means so as to urge the support arm toward the neutral position;

whereby displacement of the support arm means away from the neutral position toward at least one of the rocked-back and rocked forward positions is counteracted by the primary biasing means.

2. The apparatus of claim 1 further including a first elongate positioning means joined integrally with the support arm and extending outwardly therefrom for contacting the rigid rod means so as to limit the motion of the support arm with respect to the stand.

3. The apparatus of claim 2 wherein the rigid rod means is positioned for contacting and for moving along a sliding surface of the stand when the support arm means is moved into the rocked-back position thereby causing the primary energy storing means to retard the motion of the support arm, and whereby the rigid rod means contacts the first elongate finger so as to be thereby lifted away from the sliding surface when the support arm means is moved into the rocked-forward position thereby causing the primary energy storing means to retard the motion of the support arm.

4. The apparatus of claim 1 further including a secondary energy storing means joined at a first end thereof with the stand and at a second end thereof with the rigid rod so that when the support arm means is moved into the rocked-back position the primary energy storing means retards the motion of the support arm means, and whereby when the support arm means is moved into the rocked-forward position the secondary energy storing means retards the motion of the support arm means.

5. The apparatus of claim 2 further including a second elongate positioning means joined integrally with and extending outwardly from the stand for contacting the rigid rod means for positioning the primary energy storing means with respect to the stand whereby when the support arm means moves into the rocked-back position the rigid rod means is prevented from moving therewith.

6. The apparatus of claim 1 further including a weight means removably engagable with the support arm means and positioned for counteracting the motion of the support arm means and for adjusting the stiffness of the support arm means.

7. The apparatus of claim 1 wherein the support arm means comprises a plurality of spaced apart struts each having a distal end and a proximal end, the distal ends each being hingably engaged with the stand enabling each of the struts to move independently between the rocked-back position and the rocked forward position; the strike absorbing means being attached at the proximal end of each of the struts and movable therewith; the primary biasing means comprising at least one of the primary energy storing means and at least one of the rigid rod means, each one of the primary biasing means being engaged at one end thereof with the stand and at the other end thereof with one of the support arm means so as to urge each of the support arm means toward the neutral position; whereby displacement of the support arm means away from the neutral position toward at least one of the rocked-back and rocked forward positions is counteracted by the primary biasing means.

8. The apparatus of claim 7 further including a weight means removably engagable with the support arm means and positioned for counteracting the motion of the support arm means and for adjusting the stiffness of the support arm means.

9. The apparatus of claim 7 wherein the stand includes a primary stand arm upwardly extending from the base, and a secondary stand arm pivotally joined to the primary stand arm so as to laterally move with respect thereto; the support arm means being pivotally joined to the secondary stand arm and laterally movable therewith; a secondary stand arm bias means being positioned and engaged for urging the secondary stand arm to position the strike absorbing means in a common horizontal plane.

* * * * *